US008240524B2

(12) United States Patent
Mizobe et al.

(10) Patent No.: US 8,240,524 B2
(45) Date of Patent: Aug. 14, 2012

(54) UPPER NOZZLE

(75) Inventors: Arito Mizobe, Fukuoka (JP); Mitsunobu Sato, Fukuoka (JP); Takahiro Yasuda, Fukuoka (JP)

(73) Assignee: Krosakiharima Corporation, Fukuoka (JP)

( * ) Notice: Subject to any disclaimer, the term of this patent is extended or adjusted under 35 U.S.C. 154(b) by 213 days.

(21) Appl. No.: 12/675,298

(22) PCT Filed: Mar. 13, 2009

(86) PCT No.: PCT/JP2009/054877
§ 371 (c)(1), (2), (4) Date: Mar. 29, 2010

(87) PCT Pub. No.: WO2009/113662
PCT Pub. Date: Sep. 17, 2009

(65) Prior Publication Data

US 2010/0219212 A1 Sep. 2, 2010

(30) Foreign Application Priority Data

Mar. 14, 2008 (JP) ..... 2008-065154

(51) Int. Cl.
*B22D 41/50* (2006.01)

(52) U.S. Cl. ..... 222/591; 222/606

(58) Field of Classification Search ..... 164/337, 164/437, 488; 222/591, 590, 594, 606, 607
See application file for complete search history.

(56) References Cited

U.S. PATENT DOCUMENTS

| | | | | |
|---|---|---|---|---|
| 4,427,184 | A * | 1/1984 | Steinwider et al. | 266/45 |
| 4,510,191 | A * | 4/1985 | Kagami et al. | 428/34.4 |
| 5,310,164 | A * | 5/1994 | Rothfuss et al. | 266/45 |
| 6,409,056 | B1 * | 6/2002 | Lee | 222/606 |
| 7,556,765 | B2 | 7/2009 | Zach et al. | |
| 2007/0164491 | A1 | 7/2007 | Zach et al. | |

FOREIGN PATENT DOCUMENTS

| | | | |
|---|---|---|---|
| JP | 20000141001 | A | 5/2000 |
| JP | 2002066699 | A | 3/2002 |
| JP | 2005279729 | A | 10/2005 |
| JP | 2007-090423 | A | 4/2007 |
| JP | 2008-501854 | A | 1/2008 |
| WO | 2005/118889 | A2 | 12/2005 |

OTHER PUBLICATIONS

International Search Report published Sep. 17, 2009 for PCT/JP2009/054877 filed Mar. 13, 2009.

* cited by examiner

*Primary Examiner* — Scott Kastler
*Assistant Examiner* — Michael Aboagye
(74) *Attorney, Agent, or Firm* — Martin Fleit; Paul D. Bianco; Fleit Gibbons Gutman Bongini & Bianco PL

(57) ABSTRACT

The present invention is directed to creating a less-energy loss or smooth (constant) molten steel flow with a focus on a configuration of a bore of an upper nozzle, so as to provide an upper nozzle formed with a bore having a configuration capable of to suppress deposit formation. For this purpose, in an upper nozzle 10 for allowing molten steel to flow therethrough, a radius of an upper end of a bore 11 is set to be equal to or greater than 1.5 times a radius of a lower end of the bore 11, and a bore surface 14 is formed in a vertical cross-sectional configuration represented by $\log(r(z))=(1/n)\times\log((H+L)/(H+z))+\log(r(L))$ ($n=1.5$ to 6).

4 Claims, 13 Drawing Sheets

UPPER NOZZLE

TECHNICAL FIELD

The present invention relates to an upper nozzle adapted to be fitted into a discharge opening of a ladle or a tundish, and particularly to an upper nozzle capable of suppressing deposit formation.

BACKGROUND ART

In an upper nozzle adapted to be fitted into a discharge opening of a tundish or a ladle and formed with a bore for allowing molten steel to flow therethrough, alumina and other inclusions are apt to be attached inside the bore to form a deposit thereon, which narrows a flow passage to hinder a casting operation, or is likely to fully clog the flow passage to preclude the casting operation. As one example of a technique for preventing the deposit formation, it has been proposed to provide a gas injection port to inject an inert gas (see, for example, the following Patent Document 1 or 2).

However, an upper nozzle disclosed in the Patent Document 1 or 2 is a gas injection type, which needs to take a lot of time and effort for production due to its complicated structure, and requires an inert gas for a casting operation, resulting in increased cost. Moreover, even such a gas injection-type nozzle has difficulty in fully preventing the deposit formation.

An upper nozzle has been widely used, for example, in the following two configurations: one consisting of a reverse taper region formed on an upper (upstream) side of the upper nozzle and a straight region formed on a lower (downstream) side of the upper nozzle (see FIG. 12(*a*)); and the other having an arc-shaped region continuously extending from the reverse taper region and the straight region (see FIG. 13(*a*)). In each of FIGS. 2 to 13, the diagram (a) shows an upper nozzle which is installed in a sliding nozzle unit (hereinafter referred to as "SN unit"), wherein a region downward (downstream) of the one-dot chain line is a bore of an upper plate, and a region downward of a position where two bores are out of alignment is a bore of an intermediate plate or a lower plate.

As a result of calculation of a distribution of pressures to be applied to a wall surface of a bore (bore surface) of an upper nozzle (length: 230 mm) having the configuration illustrated in FIG. 12(*a*) during flowing of molten steel through the bore, it was verified that the pressure is rapidly changed in a region beyond a position (180 mm from an upper (upstream) end of the bore) where the bore surface is changed from a reverse taper configuration to a straight configuration, as indicated by the dotted line in FIG. 12(*b*).

Further, as a result of calculation of a distribution of pressures to be applied to a wall surface of a bore (bore surface) of an upper nozzle (length: 230 mm) having the configuration illustrated in FIG. 13(*a*) during flowing of molten steel through the bore, it was verified that the pressure is changed in an arc curve, i.e., a pressure change is not constant, as shown in FIG. 13(*b*), although a rapid pressure change is suppressed as compared with the upper nozzle illustrated in FIG. 12(*a*) which has a bore surface changed from a reverse taper configuration to a straight configuration. In each of FIGS. 2 to 13, a region rightward of the one-dot chain line in the graph (b) shows pressures to be applied to a wall surface of the bore (bore surface) of the upper plate.

The rapid pressure change and the arc-curved pressure change is caused by a phenomenon that a molten steel flow is changed as the bore surface is changed from the reverse taper configuration to the straight configuration. Further, in a swirling nozzle adapted to intentionally change a molten steel flow, a deposit is observed around a position where the molten steel flow is changed. Thus, it is considered that a deposit inside the bore of the upper nozzle can be suppressed by creating a smooth molten steel flow, i.e., a molten steel flow having an approximately constant change in pressure on the bore surface.

As a technique of stabilizing a molten steel flow, there has been proposed an invention relating to a configuration of a bore of a tapping tube for a converter (see, for example, the following Patent Document 3).

[Patent Document 1] JP 2007-90423A
[Patent Document 2] JP 2005-279729A
[Patent Document 3] JP 2008-501854A

DISCLOSURE OF THE INVENTION

Problem to be Solved by the Invention

However, a technique disclosed in the Patent Document 3 is intended to prevent a vacuum area from being formed in a central region of a molten steel flow, so as to suppress entrapment of slag and incorporation of oxygen, nitrogen, etc., but it is not intended to prevent the deposit formation. Further, the technique disclosed in the Patent Document 3 is designed for a converter (refining vessel), wherein a period when the effect of preventing entrapment of slag and incorporation of oxygen, nitrogen, etc., becomes important is a last stage of molten steel discharge (given that a tapping time is 5 minutes, the last stage is about 1 minute). In contract, for preventing the deposit formation in a ladle or a tundish (casting or pouring vessel), it is necessary to bring out an intended effect particularly in a period other than the last stage of molten steel discharge, i.e., a desired timing of bringing out an intended effect is different.

It is therefore an object of the present invention to provide an upper nozzle having a configuration of a bore, which is capable of facilitating stabilization of a pressure to be applied from an outer peripheral region of a molten steel flow onto a bore surface, so as to create a low-energy loss (smooth) molten steel flow to suppress the deposit formation.

Means for Solving the Problem

The present invention provides an upper nozzle adapted to be fitted into a discharge opening of a tundish or a ladle and formed with a bore for allowing molten steel to flow therethrough. The bore comprises a bore surface having, as viewed in cross-section taken along an axis of the bore, a configuration which is a specific curve defined to have continuous differential values of r(z) with respect to z, between two curves represented by the following respective formulas: $\log(r(z))=(1/1.5)\times\log((H+L)/(H+z))+\log(r(L))$; and $\log(r(z))=(1/6)\times\log((H+L)/(H+z))+\log(r(L))$, wherein: L is a length of the upper nozzle; H is a calculational hydrostatic head height; and r(z) is a radius of the bore at a distance z from an upper (upstream) end of the bore, and wherein: the calculational hydrostatic head height H is represented by the following formula: $H=((r(L)/r(0)^n\times L)/(1-(r(L)/r(0))^n)$ (n=1.5 to 6); and the radius r(0) of the bore at the upper end thereof is equal to or greater than 1.5 times the radius r(L) of the bore at a lower (downstream) end thereof.

In the present invention, at least 80% of the bore surface as viewed in cross-section taken along the axis of the bore may be configured as the specific curve.

In the present invention, the bore surface as viewed in cross-section taken along the axis of the bore may be configured as a specific curve represented by the following formula: $\log(r(z))=(1/n)\times\log((H+L)/(H+z))+\log(r(L))$ (n=1.5 to 6). In this case, at least 80% of the bore surface may also be configured as the specific curve.

Effect of the Invention

The present invention can suppress deposit formation on the bore of the upper nozzle for allowing molten steel to flow therethrough.

BRIEF DESCRIPTION OF DRAWINGS

FIG. 12(*a*) is representative of the prior art.

FIG. 13(*a*) is representative of the prior art.

EXPLANATION OF CODES

Figure 1:
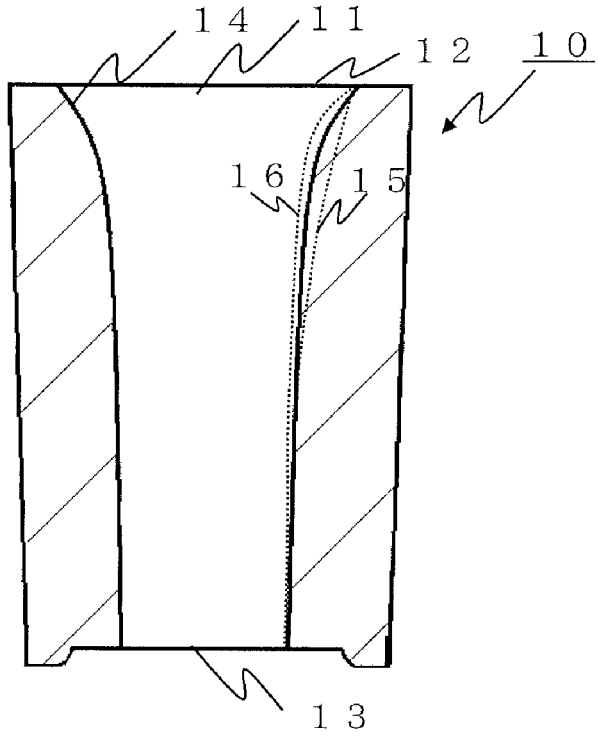
FIG. 1 is a vertical cross-sectional view showing one example of an upper nozzle according to the present invention.

10: upper nozzle
11: bore
12: large end
13: small end
14: bore surface
15: bore surface in n=1.5
16: bore surface in n=6

BEST MODE FOR CARRYING OUT THE INVENTION

With reference to the accompanying drawings, the best mode for carrying out the present invention will now be specifically described.

FIG. 1 is a cross-sectional view showing one example of an upper nozzle according to the present invention, taken along an axial direction of a bore formed in the upper nozzle to allow molten steel to flow therethrough. As shown in FIG. 1, an upper nozzle 10 according to the present invention is formed with a bore 11 for allowing molten steel to flow therethrough. The bore has a large end 12 adapted to be fitted into a discharge opening of a tundish or a ladle, a small end 13 adapted to discharge molten steel therefrom, and a bore surface 14 continuously extending from the large end 12 to the small end 13.

In the present invention, the bore surface 14 has, as viewed in cross-section taken along an axial direction of the bore 11, a configuration ($\log(r(z))$) which is a smooth curve defined between two curves 15, 16 represented by the following respective formulas: $\log(r(z))=(1/1.5)\times\log((H+L)/(H+z))+\log(r(L))$; and $\log(r(z))=(1/6)\times\log((H+L)/(H+z))+\log(r(L))$, and more preferably a curve represented by the following formula: $\log(r(z))=(1/n)\times\log((H+L)/(H+z))+\log(r(L))$ (n: 1.5 to 6). As used herein, the term "smooth curve" means a curve having continuous differential values of r(z), i.e., a line composed with a curve and a tangent to the curve.

On an assumption that a low-energy loss or smooth (constant) molten steel flow can be created by stabilizing a pressure distribution on a bore surface of an upper nozzle in a height direction of the upper nozzle, the inventors of this application has found a bore configuration of the present invention capable of suppressing a rapid change in pressure on a bore surface, as described below.

Although an amount of molten steel flowing through a bore of an upper nozzle is controlled by an SN unit disposed underneath (just downstream of) the upper nozzle, energy for providing a flow velocity of molten steel is fundamentally a hydrostatic head of molten steel in a tundish. Thus, a flow velocity v(z) of molten steel at a position where a distance from an upper end of the bore in a vertically downward (downstream) direction is z, is expressed as follows:

$$v(z)=k(2g(H'+z))^{1/2},$$

wherein: g is a gravitational acceleration; H' is a hydrostatic head height of molten steel; and k is a flow coefficient.

A flow volume Q of molten steel flowing through the bore of the upper nozzle is a product of a flow velocity v and a cross-sectional area A. Thus, the flow volume Q is expressed as follows:

$$Q=v(L)\times A(L)=k(2g(H'+L))^{1/2}\times A(L),$$

wherein: L is a length of the upper nozzle; v(L) is a flow velocity of molten steel at a lower end of the bore; and A(L) is a cross-sectional area of the lower end of the bore.

Further, the flow volume Q is constant at any position of the bore in a cross-section taken along a direction perpendicular to an axis of the bore. Thus, a cross-sectional area A(z) at a position where the distance from the upper end of the bore is z, is expressed as follows:

$$A(z)=Q/v(z)=k(2g(H'+L))^{1/2}\times A(L)/k(2g(H'+z))^{1/2}$$

The above equation can be expressed as follows by dividing each of the left-hand and right-hand sides by A(L):

$$A(z)/A(L)=((H'+L)/(H'+z))^{1/2}$$

Given that a ratio of the circumference of a circle to its diameter is π, $A(z)=7\pi r(L)^2$. The above equation is expressed as follows:

$$A(z)/A(L)=\pi r(z)^2/\pi r(L)^2=((H'+L)/(H'+z))^{1/2}r(z)/r(L)=((H'+L)/(H'+z))^{1/4} \quad (1)$$

Thus, a radius r(z) at an arbitrary position of the bore is expressed as follows:

$$\log(r(z))=(1/4)\times\log((H'+L)/(H'+z))+\log(r(L))$$

Therefore, an energy loss can be minimized by setting a cross-sectional configuration of the bore surface to satisfy this condition.

During a casting operation, an amount of molten steel in a tundish is kept approximately constant, i.e., the hydrostatic head height of molten steel is constant. However, it is known that molten steel located adjacent to a molten-steel level in the tundish does not flow directly flow into an upper nozzle but molten steel located adjacent to a bottom surface of the tundish flows into the upper nozzle. Further, in a ladle, it is known that, although a molten-steel level height is changed, molten steel located adjacent to a bottom surface of the ladle flows into an upper nozzle in the same manner as that in the tundish. A radius (diameter) of the lower end (small end) of the bore of the upper nozzle is determined by a required throughput.

Through various researches, the inventors found that a rapid pressure change which may occur in a vicinity of the upper end of the bore can be suppressed by setting an inner radius (diameter) of the upper end (large end) of the bore to be equal to or greater than 1.5 times an inner radius (diameter) of the lower end (small end) of the bore. The reason is that, if the inner radius of the upper end is less than 1.5 times the inner radius of the lower end, it is difficult to adequately ensure a distance for smoothing a configuration from the tundish or ladle to the upper nozzle, and thereby the configuration is rapidly changed. Preferably, the inner radius of the upper end is equal to or less than 2.5 times the inner radius of the lower end. The reason is that, if the inner radius of the upper end becomes greater than 2.5 times the inner radius of the lower end, a discharge opening of the tundish or ladle will be unrealistically increased.

In accordance with the above equation (1), a radius ratio of the large end to the small end of the bore is expressed as follows:

$$r(0)/r(L)=((H+L)/(H+0))^{1/4}=1.5 \text{ to } 2.5$$

This means that, if respective inner radii of the upper end and the lower end, and a ratio of the upper end to the lower end, are determined, a calculational hydrostatic head height H can be obtained. Specifically, the calculational hydrostatic head height H is expressed as follows:

$$H=((r(L)/r(0))^4\times L)/(1-(r(L)/r(0))^4)$$

Then, the inventors considered that, in an equation "log(r(z))=(1/n)×log((H+L)/(H+z))+log(r(L))" which is converted from the above equation "log(r(z))=(1/4)×log((H'+L)/(H'+z))+log(r(L))" by substituting the hydrostatic head height H' of molten steel with the calculational hydrostatic head height H, even if n is a number other than 4, a molten steel flow may become smoother than ever before as long as an upper nozzle is formed with a bore which comprises a bore surface having a cross-sectional configuration obtained by changing a value of n, and verified a pressure on a bore surface in each of a plurality of upper nozzles where the bore surface is formed in various configurations by changing the value of n.

Further, in this verification, the parameter n was also applied to convert the above equation of the calculational hydrostatic head height H, as follows:

$$H=((r(L)/r(0)^n\times L)/(1-(r(L)/r(0)^n)$$

The radius ratio of the large end to the small end of the bore is expressed as follows: $r(0)/r(L)=((H+L)/(H+0))^{1/4}=1.5$ to 2.5. Thus, if respective inner radii of the upper end and the lower end, and a ratio of the upper end to the lower end, are determined, a calculational hydrostatic head height H in each value of n can be obtained.

The present invention will be more spastically described based on examples. It is understood that the following examples will be shown simply by way of illustrative embodiments of the present invention, and the present invention is not limited to the examples.

EXAMPLE

Figure 2A:
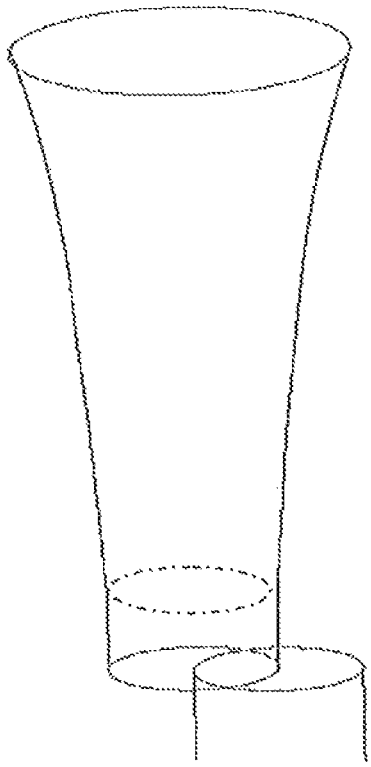
FIGS. 2(*a*) and 2(*b*) are, respectively, a diagram showing a configuration of an upper nozzle, and a graph showing a pressure distribution during flowing of molten steel through the upper nozzle, wherein n=1.5.
Figure 2B:
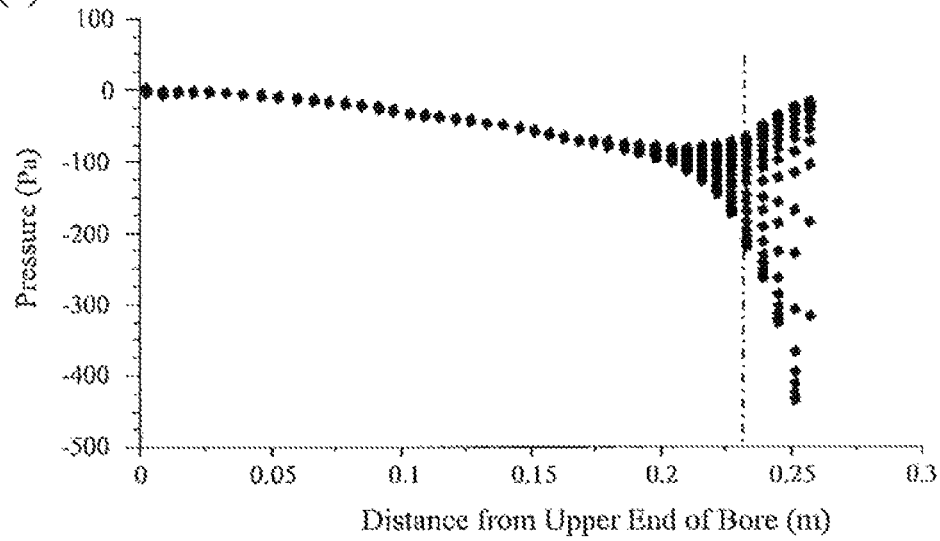
Figure 3A:
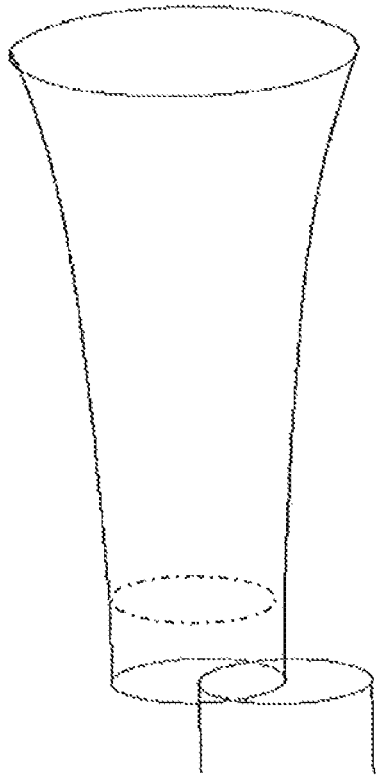
FIGS. 3(*a*) and 3(*b*) are, respectively, a diagram showing a configuration of an upper nozzle, and a graph showing a pressure distribution during flowing of molten steel through the upper nozzle, wherein n=2.
Figure 3B:
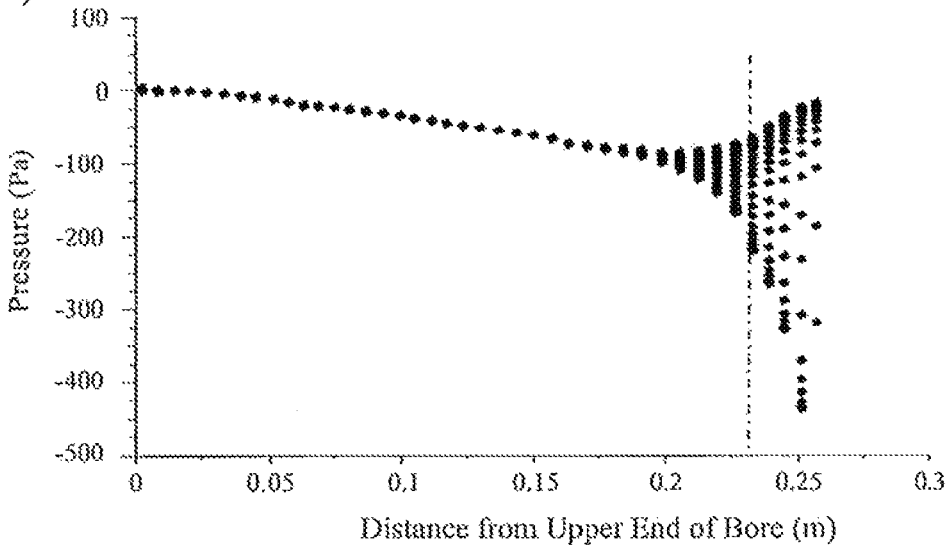
Figure 4A:
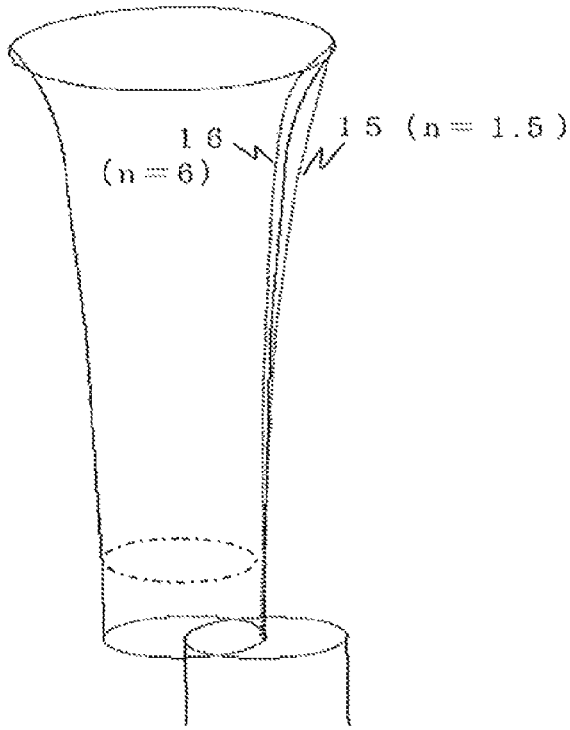
FIGS. 4(*a*) and 4(*b*) are, respectively, a diagram showing a configuration of an upper nozzle, and a graph showing a pressure distribution during flowing of molten steel through the upper nozzle, wherein n=4.
Figure 4B:
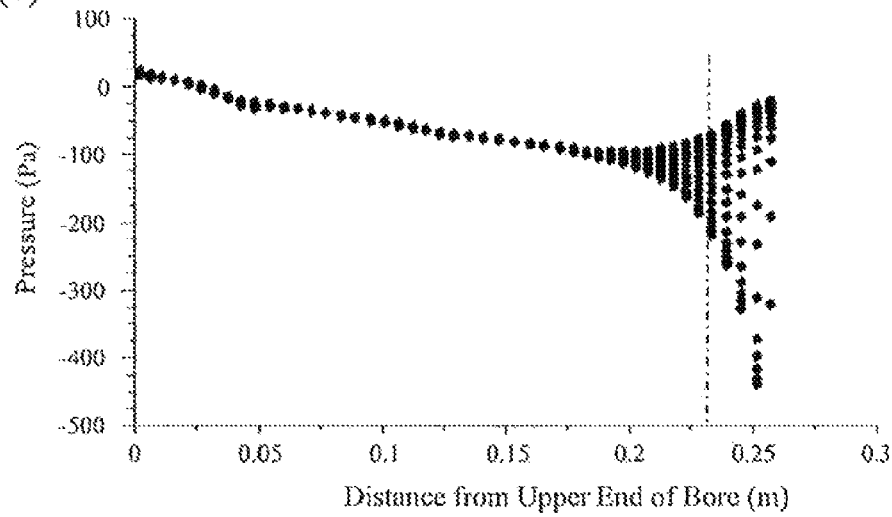
Figure 5A:
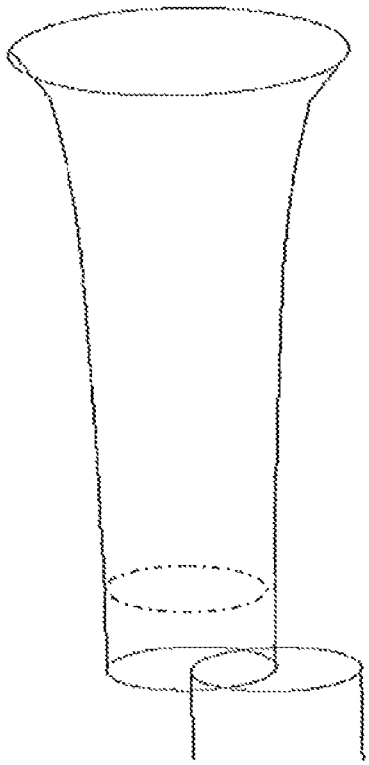
FIGS. 5(*a*) and 5(*b*) are, respectively, a diagram showing a configuration of an upper nozzle, and a graph showing a pressure distribution during flowing of molten steel through the upper nozzle, wherein n=5.
Figure 5B:
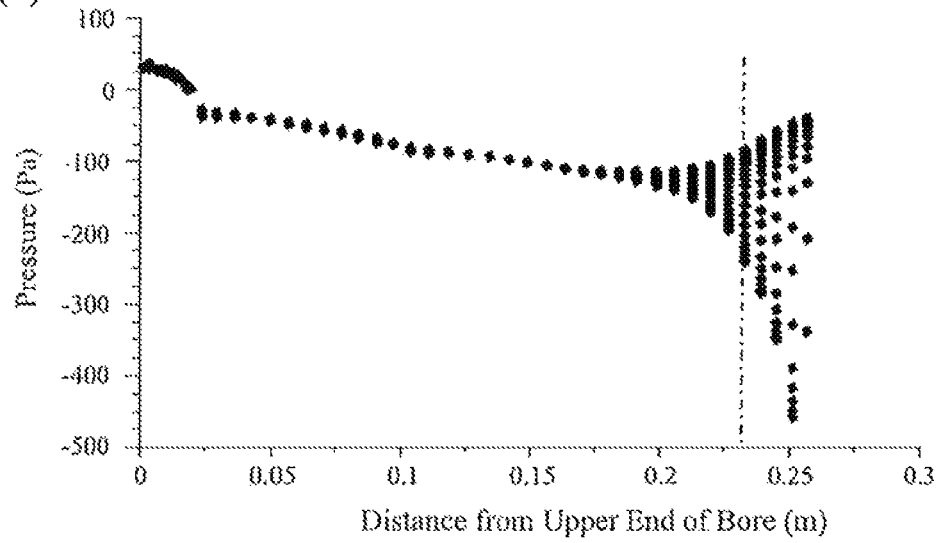
Figure 6A:
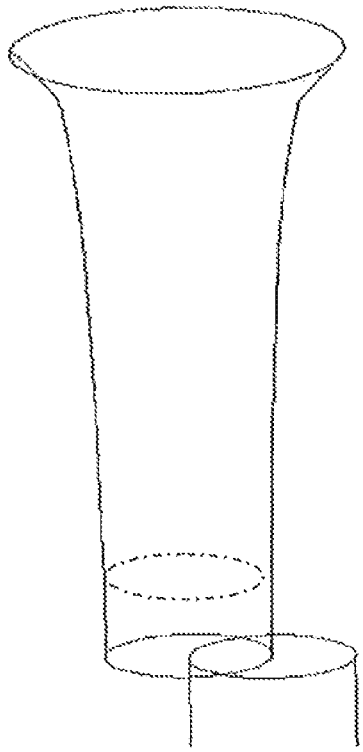
FIGS. 6(*a*) and 6(*b*) are, respectively, a diagram showing a configuration of an upper nozzle, and a graph showing a pressure distribution during flowing of molten steel through the upper nozzle, wherein n=6.
Figure 6B:
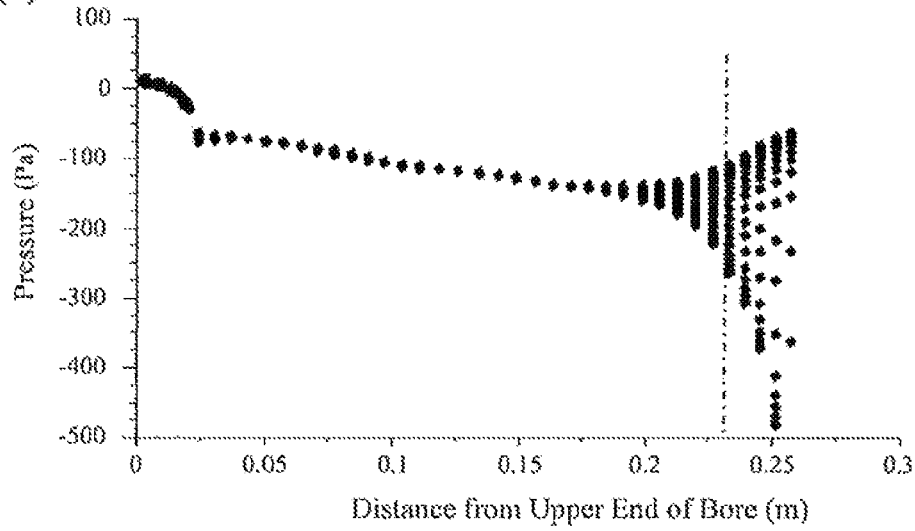
Figure 7A:
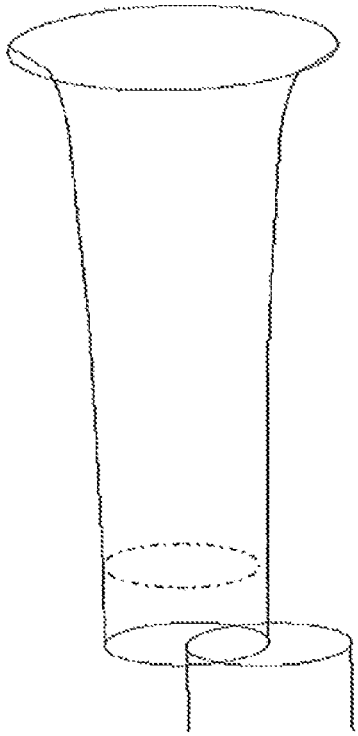
FIGS. 7(*a*) and 7(*b*) are, respectively, a diagram showing a configuration of an upper nozzle, and a graph showing a pressure distribution during flowing of molten steel through the upper nozzle, wherein n=7.
Figure 7B:
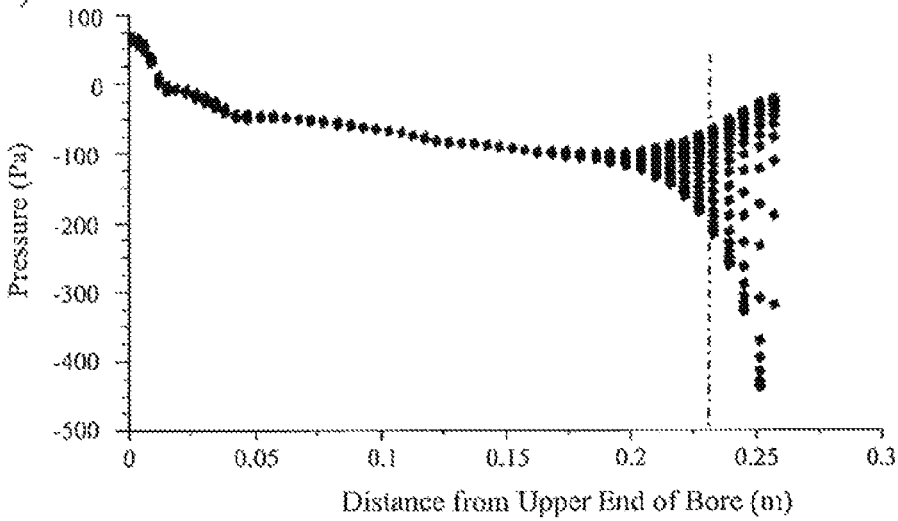
Figure 8A:
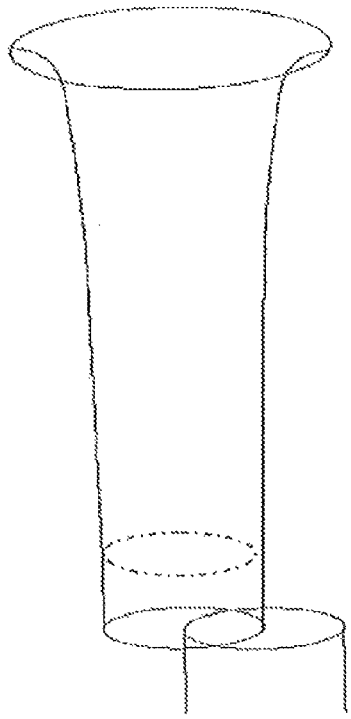
FIGS. 8(*a*) and 8(*b*) are, respectively, a diagram showing a configuration of an upper nozzle, and a graph showing a pressure distribution during flowing of molten steel through the upper nozzle, wherein n=8.
Figure 8B:
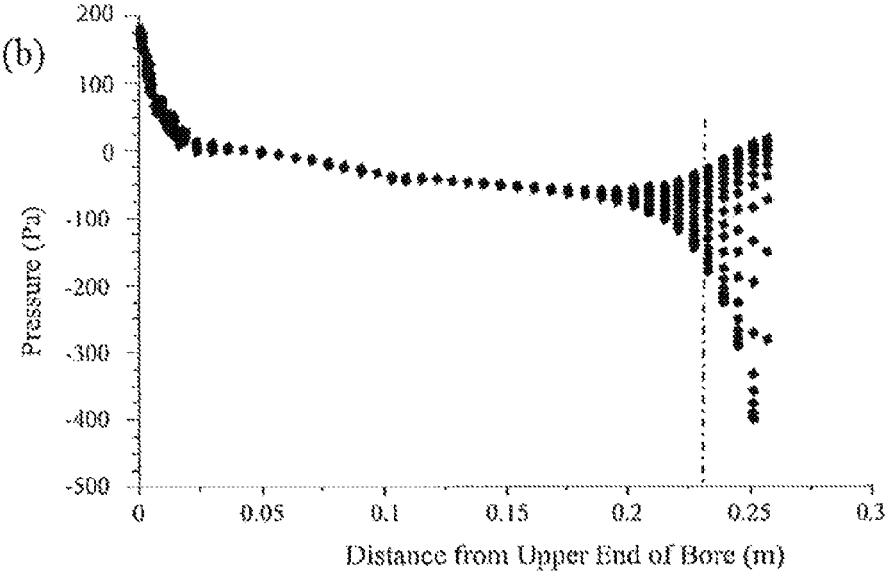
Figure 9A:
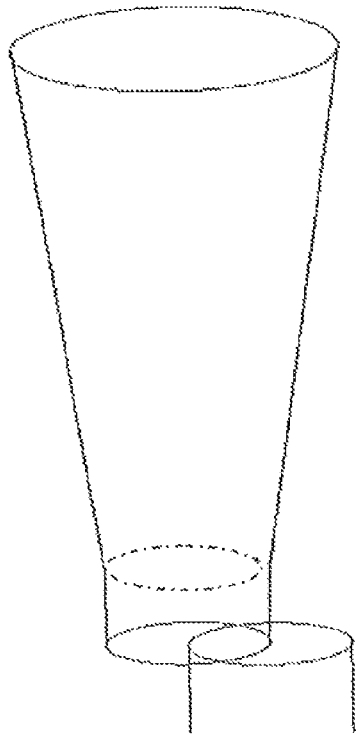
FIGS. 9(*a*) and 9(*b*) are, respectively, a diagram showing a configuration of an upper nozzle, and a graph showing a pressure distribution during flowing of molten steel through the upper nozzle, wherein n=1.
Figure 9B:
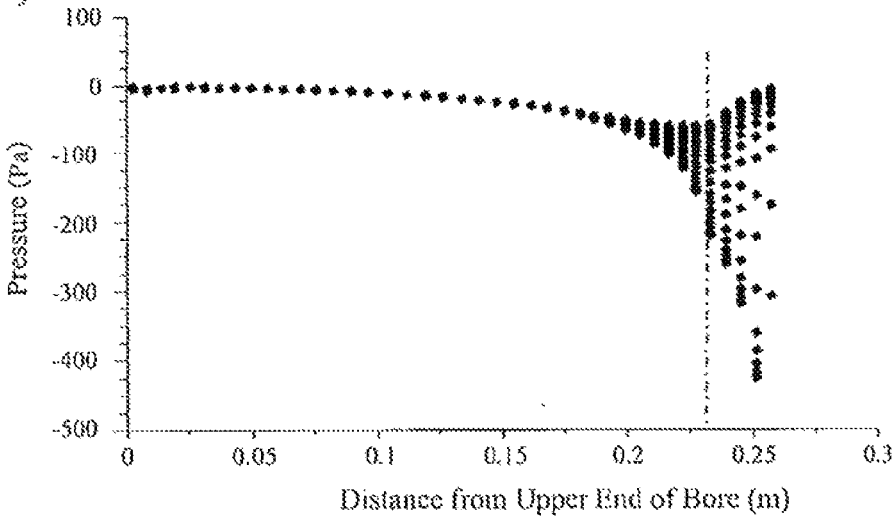

In the following examples, a distribution of pressures to be applied to a bore surface of an upper nozzle, wherein: a length of the upper nozzle is 230 mm; a diameter of a large end of a bore of the upper nozzle is 140 mm; and a diameter of a small end of the bore of the upper nozzle is 70 mm, and when a hydrostatic head height of a tundish or a ladle is 1000 mm. In Example 1, the pressure distribution was calculated using an upper nozzle illustrated in FIG. 2(*a*), where the bore surface has a configuration represented by log(r(z))=(1/n)×log((H+L)/(H+z))+log(r(L)), wherein n=1.5, i.e., log(r(z))=(1/1.5)×log((H+L)/(H+z))+log(r (L)). A result of the calculation is shown in FIG. 2(*b*) on an assumption that a pressure to be applied to a bore surface at an upper end of an upper nozzle illustrated in FIG. 11 as a conventional upper nozzle is 0 (zero). Further, in the same manner as that in Inventive Example 1, the pressure distribution was calculated using each of seven types of upper nozzles, wherein: n=2 (Inventive Example 2); n=4 (Inventive Example 3); n=5 (Inventive Example 4); n=6 (Inventive Example 5); n=7 (Comparative Example 1); n=8 (Comparative Example 2); and n=1 (Comparative Example 3), i.e., using each of:

an upper nozzle (Inventive Example 2) illustrated in FIG. 3(*a*), where the bore surface has a configuration represented by log(r(z))=(1/2)×log((H+L)/(H+z))+log(r(L));

an upper nozzle (Inventive Example 3) illustrated in FIG. 4(*a*), where the bore surface has a configuration represented by log(r(z))=(1/4)×log((H+L)/(H+z))+log(r(L));

an upper nozzle (Inventive Example 4) illustrated in FIG. 5(*a*), where the bore surface has a configuration represented by log(r(z))=(1/5)×log((H+L)/(H+z))+log(r(L));

an upper nozzle (Inventive Example 5) illustrated in FIG. 6(*a*), where the bore surface has a configuration represented by log(r(z))=(1/6)×log((H+L)/(H+z))+log(r(L));

an upper nozzle (Comparative Example 1) illustrated in FIG. 7(*a*), where the bore surface has a configuration represented by log(r(z))=(1/7)×log((H+L)/(H+z))+log(r(L));

an upper nozzle (Comparative Example 2) illustrated in FIG. 8(*a*), where the bore surface has a configuration represented by log(r(z))=(1/8)×log((H+L)/(H+z))+log(r(L)); and an upper nozzle (Comparative Example 3) illustrated in FIG. 9(*a*), where the bore surface has a configuration represented by $\log(r(z))=(1/1)\times\log((H+L)/(H+z))+\log(r(L))$. Results of the calculations are shown in FIGS. 3(*b*), 4(*b*), 5(*b*), 6(*b*), 7(*b*), 8(*b*) and 9(*b*), respectively.

In Inventive Examples 1 to 3 (n=1.5 to 4), it was verified that the pressure is gradually changed in a region from the upper end to the lower end of the bore. In view of a fact that no rapid pressure change occurs, it is proven that a molten steel flow is approximately constant.

In Inventive Examples 4 and 5 (n=5 and 6), it was verified that, although a relatively large pressure change was observed in a vicinity of the upper end of the bore, the pressure is subsequently gradually changed. It is proven that a molten steel flow is approximately constant in a region other than the vicinity of the upper end of the bore where a bore diameter is relatively large and a deposit problem is less likely to occur.

Figure 11A:
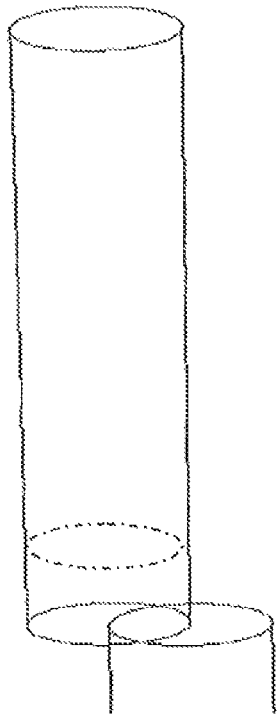
FIGS. 11(*a*) and 11(*b*) are, respectively, a diagram showing a configuration of an upper nozzle, and a graph showing a pressure distribution during flowing of molten steel through the upper nozzle, wherein the radius ratio=1.
Figure 11B:
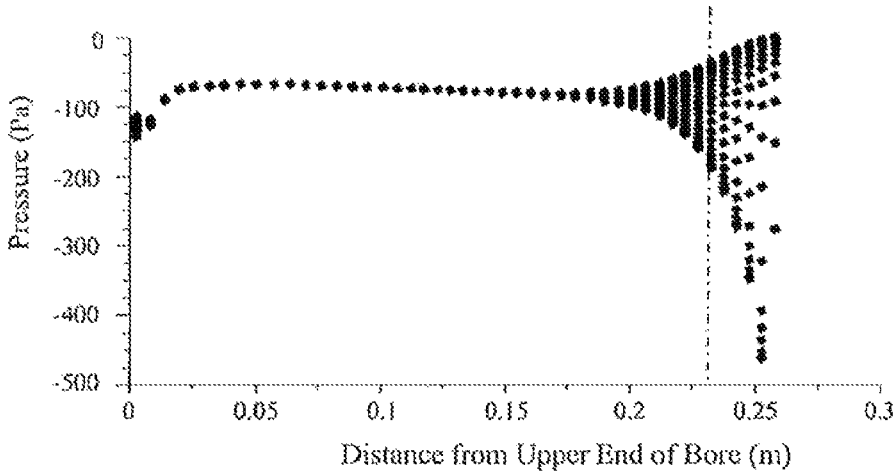
Figure 12A:
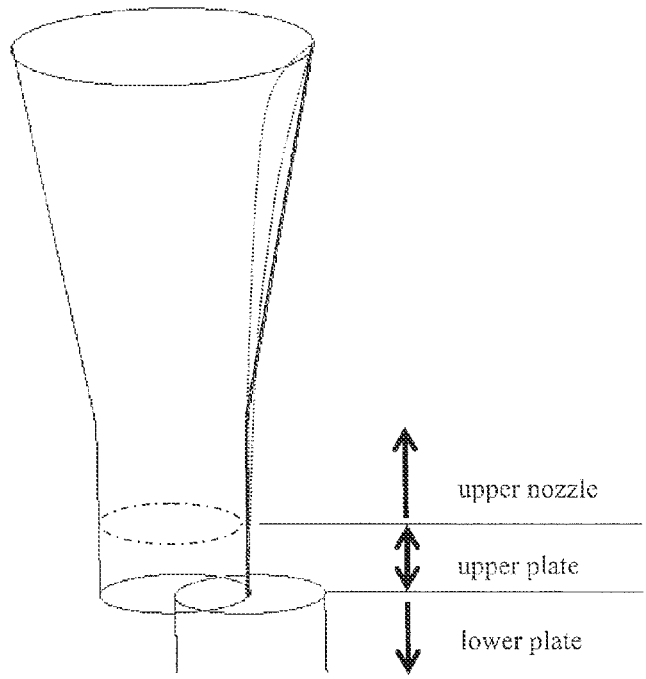
FIG. 12(a) PRIOR ART
FIGS. 12(*a*) and 12(*b*) are, respectively, a diagram showing a configuration of a conventional upper nozzle, and a graph showing pressure distribution during flowing of molten steel through the conventional upper nozzle.
Figure 12B:
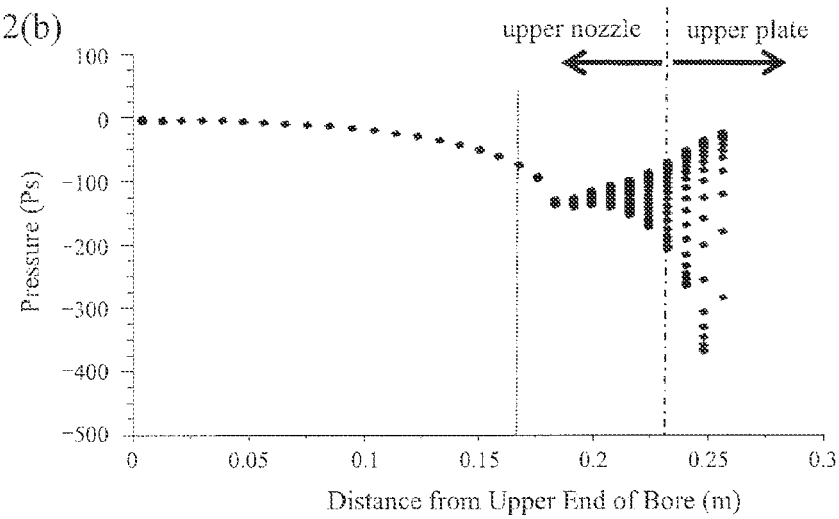
Figure 13A:
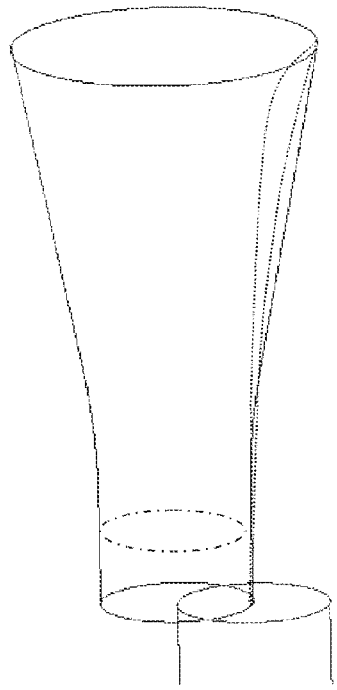
FIG. 13(a) PRIOR ART
FIGS. 13(*a*) and 13(*b*) are, respectively, a diagram showing a configuration of a conventional upper nozzle, and a graph showing pressure distribution during flowing of molten steel through the conventional upper nozzle.
Figure 13B:
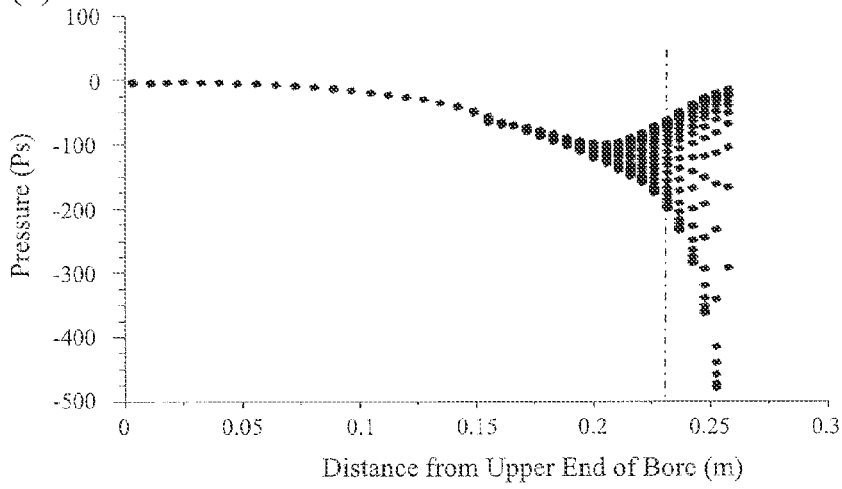

In Comparative Examples 1 and 2 (n=7 and 8), the pressure is largely changed from about 100 Pa or about 200 Pa in a vicinity of the upper end of the bore. Specifically, it was verified that a pressure greater than that in the conventional upper nozzle illustrated in FIG. 11 is generated at the upper end of the bore, and then an extremely large pressure change occurs in the vicinity of the upper end of the bore. In Comparative Examples 1 and 2, it is proven that, due to a radius (diameter) of the bore sharply reduced in the vicinity of the upper end of the bore, a molten steel flow is rapidly changed in a region where a bore diameter is relatively small and the deposit problem is more likely to occur.

In Comparative Example 3 (n=1), where the bore inner wall has a reverse taper configuration, and a corner is formed in a contact region with the upper plate, it was verified that, although a pressure change in the upper nozzle is relatively small, a rapid pressure change occurs just after molten steel flows from the upper nozzle into the upper plate, as evidenced, for example, by a comparison between FIG. 2(*b*) and FIG. 9(*b*)

As above, in the present invention, it is proven that a change in pressure to be applied to the bore surface is approximately constant during flowing of molten steel through the bore of the upper nozzle, i.e., a molten steel flow is low in energy loss, or constant. A molten-steel level in a ladle is gradually lowered from about 4000 mm, and a molten-steel level in a tundish is about 500 mm. However, as mentioned above, molten metal flowing into the discharge opening is molten metal located adjacent to a bottom surface of the tundish or the ladle. Thus, even if the molten-steel level height is changed, a pressure distribution has the same characteristic as those in Inventive and Comparative Examples, although a value of the pressure is changed.

Inventive Example 6

Figure 10A:
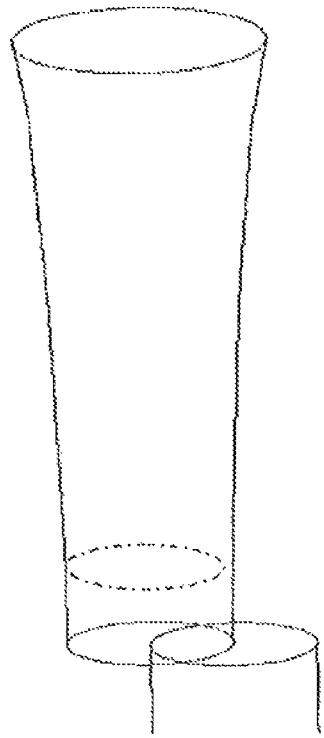
FIGS. 10(*a*) and 10(*b*) are, respectively, a diagram showing a configuration of an upper nozzle, and a graph showing a pressure distribution during flowing of molten steel through the upper nozzle, wherein n=4, and a radius ratio=1.5.
Figure 10B:
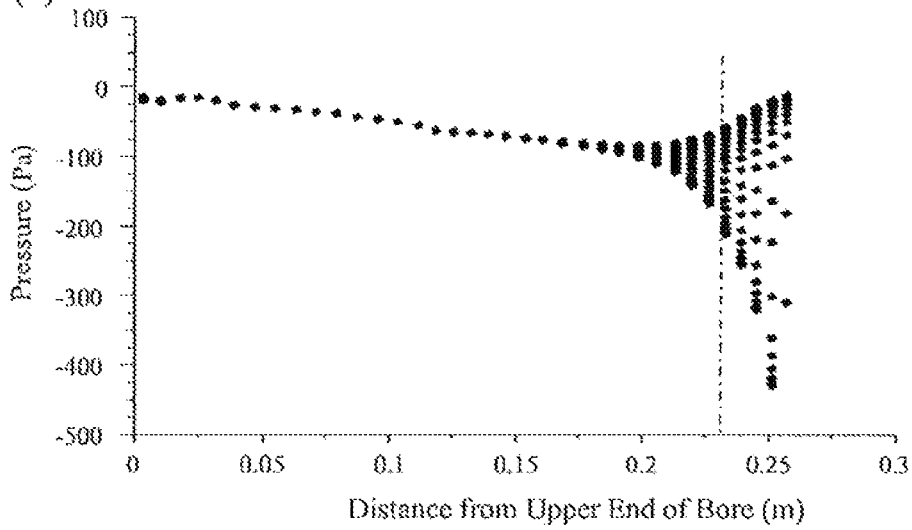

In Inventive Example 6, the pressure distribution was calculated in the same manner as that in Inventive Example 1, using an upper nozzle illustrated in FIG. 10(*a*), wherein: a length of the upper nozzle is 230 mm; a diameter D of a small end (lower end) of a bore of the upper nozzle is 70 mm; a diameter of a large end (upper end) of the bore of the upper nozzle is 108 mm which is 1.5 times the diameter D of the small end of the bore (1.5D); and n is 4, i.e., the bore surface has a configuration represented by $\log(r(z))=(1/4)\times\log((H+L)/(H+z))+\log(r(L))$. A result of the calculation is shown in FIG. 10(*b*).

Comparative Example 4

In Comparative Example 4, the pressure distribution was calculated in the same manner as that in Inventive Example 1, using an upper nozzle illustrated in FIG. 11(*a*), wherein: a length of the upper nozzle is 230 mm; a diameter D of a small end (lower end) of a bore of the upper nozzle is 70 mm; a diameter of a large end (upper end) of the bore of the upper nozzle is 73 mm which is about 1 time the diameter D of the small end of the bore (1.06D); and n is 4, i.e., the bore surface has a configuration represented by $\log(r(z))=(1/4)\times\log((H+L)/(H+z))+\log(r(L))$. A result of the calculation is shown in FIG. 11(*b*).

In Comparative Example 4 where a radius (diameter) ratio of the large end to the small end of the bore is about 1 (1.06), a pressure change in a vicinity of the upper end of the bore is relatively large. In contract, in Inventive Example 6 where the radius ratio is 1.5 (the radius of the upper end: 1.5D), and Inventive Example 3 where the radius ratio is 2 (the radius of the upper end: 2D), it was verified that a pressure change is approximately constant even in a vicinity of the upper end of the bore. In the case where the configuration of the bore surface is represented by the $\log(r(z))$, a wall surface continuously extending from a tundish or a ladle to the upper nozzle becomes smoother along with an increase in radius (diameter) of the bore. This proves that a rapid pressure change in the vicinity of the upper end of the bore can be suppressed by setting the radius (diameter) of the upper end of the bore to be equal to or greater than 1.5 times the radius (diameter) of the lower end of the bore.

Further, if there is a corner or a corner-like configuration, a rapid pressure change is observed as in the pressure changes in the conventional upper nozzle and Comparative Examples 1 to 4. Thus, when a bore surface is formed in a vertical cross-sectional configuration defined between $\log(r(z))=(1/1.5)\times\log((H+L)/(H+z))+\log(r(L))$ and $\log(r(z))=(1/6)\times\log((H+L)/(H+z))+\log(r(L))$, in such a manner as to become smooth and free from formation of a corner, i.e., to have continuous differential values of r(z) with respect to z ($d(r(z))/dz$), a metal steel flow can be stabilized so as to suppress the deposit formation.

A configuration of a region adjacent to the upper end of the bore is likely to be determined by a factor, such as a configuration of a stopper. Further, the region adjacent to the upper end of the bore is relatively large in inner radius (diameter), and less affected by a deposit. In contract, a configuration of a region adjacent to the lower end of the bore is likely to be determined by a factor in terms of production. For example, in some cases, the region adjacent to the lower end of the bore has to be formed in a straight body due to a need for inserting a tool thereinto during a production process. Thus, the bore surface may be formed in the vertical cross-sectional configuration represented by $\log(r(z))=(1/n)\times\log((H+L)/(H+z))+\log(r(L))$ (n=1.5 to 6), by at least 80% thereof. Further, a bubbling mechanism adapted to inject an inert gas, such as Ar gas, may be used in combination.

The invention claimed is:

1. An upper nozzle configured for fitting into a discharge opening of a tundish or a ladle, the upper nozzle formed with a bore for allowing molten steel to flow therethrough, the bore comprising a bore surface having, as viewed in cross-section taken along an axis of the bore, a configuration which is a curve defined to have continuous differential values of r(z) with respect to z, between two curves represented by respective formulas: $\log(r(z))=(1/1.5)\times\log((H+L)/(H+z))+\log(r(L))$; and $\log(r(z))=(1/6)\times\log((H+L)/(H+z))+\log(r(L))$, wherein: L is a length of the upper nozzle; H is a calculational hydrostatic head height; and r(z) is a radius of the bore at a distance z from an upper end of the bore, and wherein:

the calculational hydrostatic head height H is represented by formula: $H=((r(L)/r(0))^n \times L)/(1-(r(L)/r(0))^n)$ (n=1.5 to 6); and the radius r(0) of the bore at the upper end thereof is equal to or greater than 1.5 times the radius r(L) of the bore at a lower end thereof.

2. An upper nozzle configured for fitting into a discharge opening of a tundish or a ladle, the upper nozzle formed with a bore for allowing molten steel to flow therethrough, the bore comprising a bore surface having, as viewed in cross-section taken along an axis of the bore and in at least 80% of the bore surface, a configuration which is a curve defined to have continuous differential values of r(z) with respect to z, between two curves represented by respective formulas: $\log(r(z))=(1/1.5)\times\log((H+L)/(H+z))+\log(r(L))$; and $\log(r(z))=(1/6)\times\log((H+L)/(H+z))+\log(r(L))$, wherein: L is a length of the upper nozzle; H is a calculational hydrostatic head height; and r(z) is a radius of the bore at a distance z from an upper end of the bore, and wherein:

the calculational hydrostatic head height H is represented by formula: $H=((r(L)/r(0))^n \times L)/(1-(r(L)/r(0))^n)$ (n=1.5 to 6); and the radius r(0) of the bore at the upper end thereof is equal to or greater than 1.5 times the radius r(L) of the bore at a lower end thereof.

3. An upper nozzle configured for fitting into a discharge opening of a tundish or a ladle, the upper nozzle formed with a bore for allowing molten steel to flow therethrough, the bore comprising a bore surface having, as viewed in cross-section taken along an axis of the bore, a configuration which is a curve represented by formula: $\log(r(z))=(1/n)\times\log((H+L)/(H+z)+\log(r(L))$, wherein: L is a length of the upper nozzle; H is a calculational hydrostatic head height; r(z) is a radius of the bore at a distance z from an upper end of the bore; and n is in a range of 1.5 to 6, and wherein:

the calculational hydrostatic head height H is represented by formula: $H=((r(L)/r(0))^n \times L)/(1-(r(L)/r(0))^n)$ (n=1.5 to 6); and the radius r(0) of the bore at the upper end thereof is equal to or greater than 1.5 times the radius r(L) of the bore at a lower end thereof.

4. An upper nozzle configured for fitting into a discharge opening of a tundish or a ladle, the upper nozzle formed with a bore for allowing molten steel to flow therethrough, the bore comprising a bore surface having, as viewed in cross-section taken along an axis of the bore and in at least 80% of the bore surface, a configuration which is a curve represented by formula: $\log(r(z))=(1/n)\times\log((H+L)/(H+z)+\log(r(L))$, wherein: L is a length of the upper nozzle; H is a calculational hydrostatic head height; r(z) is a radius of the bore at a distance z from an upper end of the bore; and n is in a range of 1.5 to 6, and wherein:

the calculational hydrostatic head height H is represented by formula: $H=((r(L)/r(0))^n \times L)/(1-(r(L)/r(0))^n)$ (n=1.5 to 6); and the radius r(0) of the bore at the upper end thereof is equal to or greater than 1.5 times the radius r(L) of the bore at a lower end thereof.

* * * * *